US005660487A

United States Patent [19]

Cayzer

[11] Patent Number: 5,660,487

[45] Date of Patent: Aug. 26, 1997

[54] LABEL PRINTING APPARATUS

[75] Inventor: John Anthony Cayzer, Runcorn, Great Britain

[73] Assignee: R.H.S. International Limited, Cheshire, Great Britain

[21] Appl. No.: 170,285

[22] PCT Filed: Jul. 6, 1992

[86] PCT No.: PCT/GB92/01223

§ 371 Date: Mar. 3, 1994

§ 102(e) Date: Mar. 3, 1994

[87] PCT Pub. No.: WO93/01055

PCT Pub. Date: Jan. 21, 1993

[30] Foreign Application Priority Data

Jul. 4, 1991 [GB] United Kingdom ..... 9114512

[51] Int. Cl.[6] ..... B41J 2/315

[52] U.S. Cl. ..... 400/120.17; 400/120.16; 347/197; 347/198

[58] Field of Search ..... 400/55, 58, 120.17, 400/120.16, 124.2, 614.1, 618; 347/197, 198

[56] References Cited

U.S. PATENT DOCUMENTS 4,039,065 8/1977 Seki et al. ..... 400/120.16
4,098,389 7/1978 Kwan ..... 400/58
4,134,696 1/1979 Hanakata et al. ..... 400/120.16
4,755,833 7/1988 Tanigawa et al. ..... 400/618
4,955,738 9/1990 Uchikata et al. ..... 400/120.17
5,001,498 3/1991 Shimizu et al. ..... 400/618
5,040,461 8/1991 Van-Ocker ..... 400/120.17
5,071,266 12/1991 Harada et al. ..... 400/120.17
5,073,051 12/1991 Gugel et al. ..... 400/124.2

*Primary Examiner*—John S. Hilten
*Attorney, Agent, or Firm*—Longacre & White

[57] ABSTRACT

The invention provides an improved label printing apparatus comprising, in a first aspect, a printer head for printing information on a plurality of labels carried on a backing sheet, the printer head being mounted on a carrier plate which is hingedly mounted along one edge thereof so as to be displaceable between a first printing position and a second non-printing position, the apparatus being provided with means to cause such displacement comprising first magnetic means arranged to hold the carrier plated in the second position against a force exerted by a spring which is compressed in this position, the means further including second magnetic means having a reversible polarity such that the carrier plated may be attracted or repelled thereto or repelled therefrom.

13 Claims, 3 Drawing Sheets

LABEL PRINTING APPARATUS

This invention relates to improved label printing apparatus particularly for the printing of information on a plurality of self-adhesive labels by way of, for example, a thermal transfer printer.

It is known to provide printing apparatus for providing various printed information on to self-adhesive labels. This is especially useful for the packaging and retail sales industries where pricing and/or stock labels may be required to be adhered to a large number of individual items. In this way information relating to pricing and/or stock quantities etc. may be applied to the items using standard alphanumeric symbols or machine readible codes, for example, a bar code.

In the printing of such labels a backing sheet to which a large number of labels are adhered is passed below a printer head. The backing sheet is momentarily (approximately 1/100th second ) stopped below the printer head, which is then operated to print one line of information on the label. The backing sheet is then moved incrementally to provide for successive lines of printed information. Once all the information has been printed onto an individual label the backing sheet is again moved to align the next label with the printer head for further printing.

It will be thus be appreciated that the mechanism for moving the labels below the printer head must be capable of stopping and starting accurately and rapidly. Furthermore, the mechanism must also be capable of moving the label through the small distance required for the printing of a new line and the relatively large distance required for the alignment of a successive label.

Additionally the printer head means itself must be rapidly and accurately raised and lowered with respect to the label's surface. It will be understood that the label cannot be moved independently of the inking medium, for example foil or ribbon whilst the print head is in contact therewith and there must therefore be some movement of the print head away from the inking medium, before the backing sheet and attached label can be moved without movement of the inking media.

As it is a common a requirement that such labels should be printed fairly rapidly the movement of the backing sheet and of the printing head must be carefully synchronised such that the maximum number of lines of information may be printed on each label in the shortest possible time. Where the printing head mechanism uses a separate printing foil or ribbon it will be understood that whilst the ribbon or foil should be moved for the printing of a new line on one label the foil or ribbon should remain stationary whilst a successive label is being aligned.

Thus the foil or ribbon will at some stages be moving in co-operation with the underlying label and backing sheet whilst at other times it will be required to remain stationary during such movement. It is therefore often necessary to provide two distinct movement mechanisms for the ribbon (or foil) and for the backing sheet and its associated labels. During movement of each of the mechanisms it is important that tension is maintained in both the backing sheet and the foil or ribbon in order that clear and accurate printing is produced.

It is an object of the invention to provide in a first aspect improved label printing apparatus in which the movement of the printer head with respect to the labels to be printed is faster than heretofore possible.

It is a further object of a second aspect of the invention to provide improved label printing apparatus including a feed mechanism operative to maintain tension on a reel of labels as it is passed through the apparatus and on a reel of inking medium.

With this first object in view a first aspect of the invention provides improved label printing apparatus comprising a printer head for printing information on a plurality of labels carried on a backing sheet, the printer head being mounted on a carrier plate which is hingedly mounted along one edge thereof so as to be displaceable between a first printing position and a second non-printing position, the apparatus being provided with means to cause such displacement comprising first magnetic means arranged to hold the carrier plate in the second position against a force exerted by a spring which is compressed in this position, the means further including second magnetic means having a reversible polarity such that the carrier plate may be attracted thereto or repelled therefrom.

With such an arrangement the carrier plate is normally held in the second non-printing position by the first magnetic means acting against the force exerted by the spring. When the polarity of the second magnetic means is arranged to repel the carrier plate the attraction between the plate and the first magnetic means is broken and under the combined forces of the spring and the second magnetic means the carrier plate is urged into its first printing position.

Reversal of the polarity of the second magnetic means to attract the carrier plate will raise the carrier plate due to the combined attraction of both the first and second magnetic means and against the downward force exerted by the spring.

This arrangement has the advantage that the movement of the carrier plate is not solely dependent on gravity or spring pressure and is hence quicker and more accurate than when a single magnet is used.

It will be appreciated that the first magnetic means is arranged to attract the carrier plate constantly and therefore a permanent magnet is preferably used. This is advantageously located between two adjacent electro-magnets.

The second magnetic means is preferably an electromagnet such that its polarity may be easily reversed to attract or repel the carrier plate as required.

In a preferred embodiment of the invention the first and second magnetic means are electromagnets having separate windings arranged around a common core piece.

Advantageously the first and second magnetic means and the spring are located substantially at a free edge of the carrier plate opposed to the hinged mounting thereof.

The spring means may be any convenient spring, for example, a helical compression spring, as required according to the available space in the apparatus.

A second aspect of the invention provides improved label positioning apparatus comprising a feed mechanism for moving a plurality of labels carried on a backing sheet to a printer, the feed mechanism including a supply reel carrying a rolled backing sheet for a plurality of labels, the mechanism also including a plurality of guides operative to define a feed path for the backing sheet at least between the supply reel and printer, characterised in that at least two of the plurality of guides are provided by a pair of input rollers around each of which the backing sheet is at least partially looped, at least one of the pair of rollers being rotatably driven by motor means which also serve to drive at least one of a pair of nip rollers located below the printer's printer head and around which the backing sheet is passed.

With such an arrangement the tension on the backing sheet is maintained between the input rollers and the printer roller which are driven by common motor means so that the labels are moved under the printer head and over a print roller in a push feed manner.

In an advantageous modification the feed mechanism further includes a third output roller located so as to support the backing sheet after it passes the print roller, which third output roller is also driven by the motor means.

Advantageously a slipping clutch mechanism is arranged to connect the third output roller with the flexible belt and the print roller such that a tension is maintained on the backing sheet as it passes the printer head.

Preferably the pair of input rollers are arranged such that their axes of rotation are arranged substantially parallel to each other and on a plane parallel to that of backing sheet as it travels to the print roller, the backing sheet being looped around a first input roller located substantially nearer to the print roller, the backing sheet then being guided away from the print roller until it is looped around the second input roller through an angle of at least 180° before being fed onto the print roller located below the printer's printer head.

Advantageously the pair of input rollers are linked, for example, by way of a gear mechanism, such that both rollers are driven by the same motor means.

Preferably the motor means is connected to the output roller and to the input roller(s) by a flexible drive belt.

Optionally the third output roller may be connected by a flexible belt to the print roller such that it rotates in co-operation therewith.

In a modified aspect of this invention the twin input rollers are provided so as to form guide paths for a printer ribbon or foil operative to move that foil or ribbon past the printer head when it is required to print characters onto a label.

The invention will be described further by way of example with reference to the accompanying drawings in which.

Figure 1:
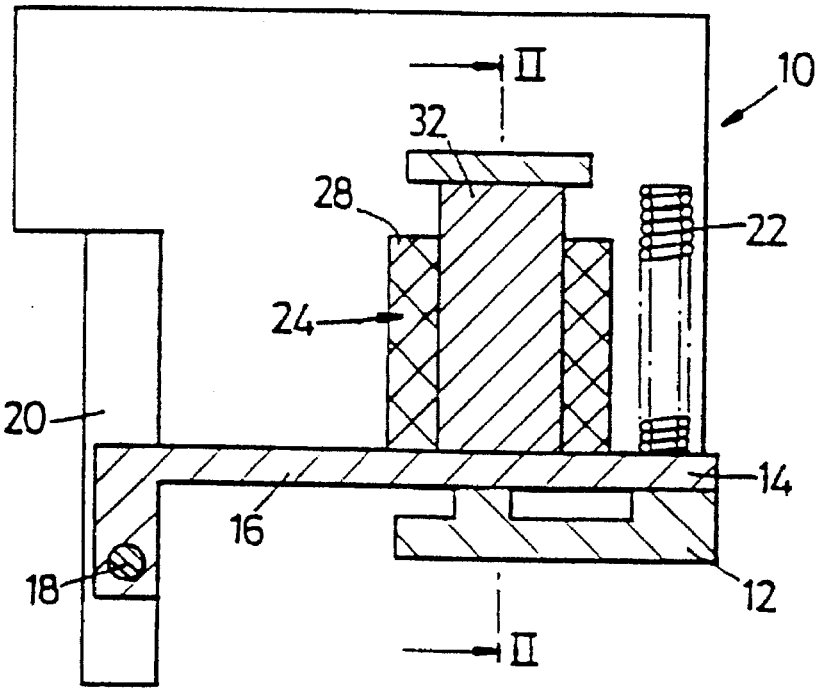
FIG. 1 is a side cross-sectional view of a first aspect of the invention.

Referring firstly to FIG. 1, improved label printing apparatus is referred to generally by the reference numeral 10 and includes a printer head 12 for printing information on a plurality of labels (not shown) carried on a backing sheet. The printer head 12 is mounted near one free edge 14 of a carrier plate 16. The carrier plate 16 is hingedly mounted by a pin 18 to a hinge block 20. This hinge block 20 is rigidly mounted (not shown) with respect to the apparatus 10.

In this way the carrier plate 16 is movable between a first printing position and a second, raised, non-printing position as shown in FIG. 1.

In order to displace the carrier plate 16 between its first and second positions it is provided with means comprising a helical compression spring 22 arranged to exert a force against the edge 14 of the carrier plate 16. This compression spring 22 is normally compressed in the non-printing position and its tension is released in the printing position.

Figure 2:
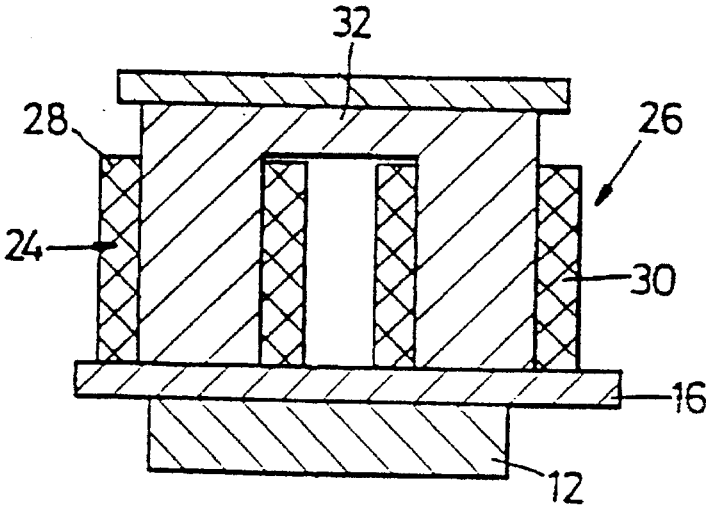
FIG. 2 is a front sectional view taken along the line II—II of FIG. 1.

The means to cause displacement of the carrier plate 16 further includes two electromagnets 24, 26 (see FIG. 2). These two electromagnets 24, 26 are formed by two windings 28, 30 respectively arranged around arms of a U-shaped core 32.

One of the two electromagnets, for example, 24 is permanently charged so that it will attract the carrier plate 16 upwardly against the action of the helical spring 22. Switching means (not shown) is provided to reverse the polarity of the second electromagnet 26 such that it can either attract or repel the carrier plate 16.

In use it will be understood that as a plurality of labels are moved below the printer head 12, it will be required to be lowered so as to permit printing of a number of characters onto the label in one or more lines. In order to permit the label to be advanced to its next printing position, whether this is a subsequent line on the same label, or the positioning of a further label it will be necessary to raise the printer head 12 and remove it from contact with the label. In order to do this the polarity of the second winding 30 is arranged such that the carrier plate 16 is attracted from its second printing position and thereby raised until it contacts the first and second electromagnets 24, 26. This raising action is against the force exerted by the compression spring 22.

When the label has been moved to its next printing position the polarity of the second electromagnet 26 is reversed through the winding 30 and the carrier plate 16 is repelled therefrom. This repelling by the second electromagnet 26 breaks the attraction with the first electromagnet 24 and aided by the release of the compression spring 22 urges the printer head downwards onto the label.

Since the force of the second electromagnet is aided in each direction by the existing forces of the first electromagnet and the spring respectively the movement of the printer head is positive and provides a faster response time than that heretofore possible. This permits a greater rate of printing and feeding of labels below the printer head and hence a high rate of production of printed labels.

Figure 3:
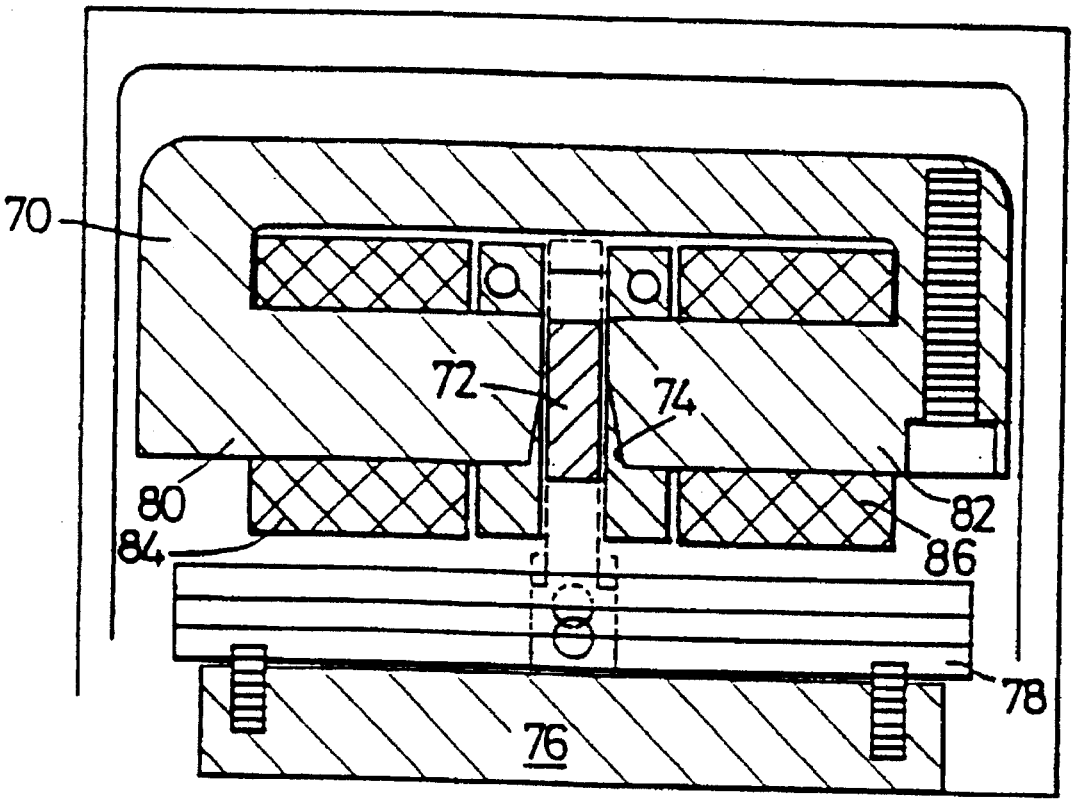
FIG. 3 is a front sectional view of a second embodiment the first aspect of the invention.

In FIG. 3 an alternative embodiment of this first aspect is illustrated in which a C-shaped core 70 is arranged with a metal plate 72 locatable in the core's gap 74. The plate 72 is attached to the back of a printer head 76 which is hingedly carried by a carrier plate 78 in a manner similar to that shown in FIG. 1. The core's two arms 80, 82 are each surrounded by a respective winding 84, 86 to provide two electro-magnets and the arms opposed faces are angled to outwardly towards the carrier plate.

In this way, when the electro-magnets 84, 86 are actuated, the plate 72 will be drawn upwardly into the gap 74. Release will cause the plate to move downwardly under the action of a tension spring (not shown)disposed similarly to that shown in FIG. 1.

Figure 4:
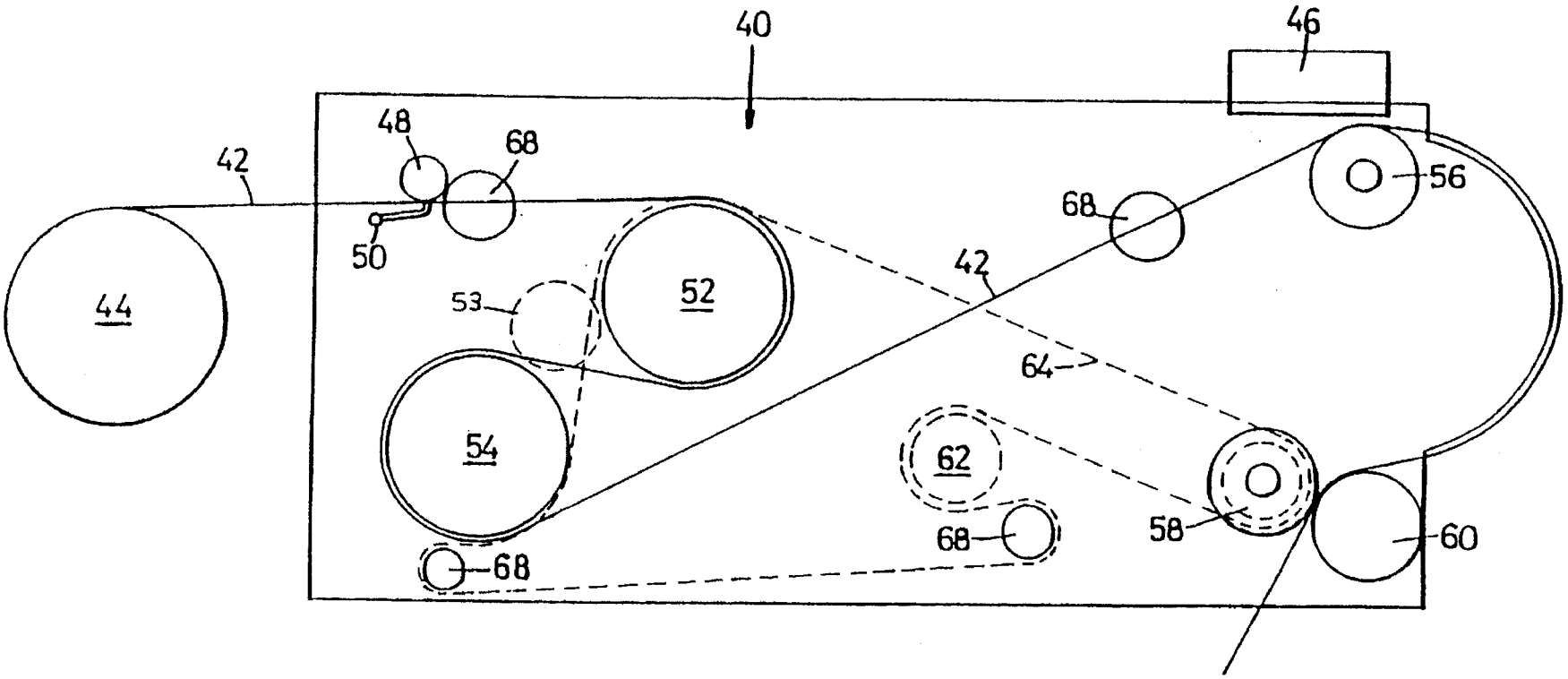
FIG. 4 is a diagramatical view of a second aspect of the invention.

Turning now to FIG. 4 a second aspect of the invention provides improved label printing apparatus comprising an improved feed mechanism referred to generally by the reference numeral 40 for moving a plurality of labels (not shown) carried on a backing sheet 42. The backing sheet and the labels are together rolled onto to supply reel 44 and arranged to pass through the mechanism 40 and below a print head mechanism 46. The pathway for the backing sheet 42 through the mechanism 40 is defined by a plurality of guides arranged within the mechanism.

A first guide 48 in the form of a fixed pillar having a substantially smooth outer surface defines the guide path between itself and a spring 50 which is arranged to urge the backing sheet and labels against the pillar 48. This provides a relatively small initial tension on the backing sheet.

After passing between the pillar 48 and spring 50 the backing sheet 42 is wound through at least 180° around an input roller 52. This roller is provided with a gear mechanism 53 linking it with a second input roller 54 arranged relatively close thereto and around which the backing sheet is wound through at least a further 180°. After leaving the second input roller the backing sheet 42 passes through the mechanism 40 and around a print roller 56 which is arranged substantially below the printer head mechanism 46. The printer head mechanism 46 is advantageously of the form illustrated in FIGS. 1 and 2 such that the printer head can be raised and lowered with respect to the print roller 56. In this way the backing sheet can be held onto the roller 56 when the printer head is printing and released therefrom to permit movement when a new line of print or a further label is to be printed.

After passing below the printer head 46 the backing sheet, and attached labels, is fed around a convex curved surface, between a further pair of output rollers 58, 60 and thence to a collection or rewinding mechanism (not shown) for subsequent use or storage.

It will be understood that in order to provide for the movement of the backing sheet 42 through the mechanism 40 it will be necessary to provide motor means to drive at least one of the rollers in the mechanism 40. In this instance an electric motor drive mechanism (not shown) is provided in the mechanism substantially at the point indicated generally by the reference numeral 62. This motor 62 drives a flexible belt 64 indicated by dotted lines and connecting the motor and first and secured input rollers 52, 54, and one output roller 58. Thus an output roller and the input roller are rotated by the action of the motor to draw the backing-sheet and labels off the supply reel and feed them over the print roller 56 and below the printer head as required. It will be noted that the gear linkage 53 of the first and second input rollers 52, 54 provides simultaneous rotation of each of these rollers in opposite direction thus maintaining the tension of the backing sheet around those two rollers.

In order that a tension is maintained in the backing sheet at all times, the flexible drive connection to the output roller 58 is preferably arranged through a slipping clutch mechanism and an overdrive mechanism such that the output roller 58 rotates slightly faster than the print roller 56. The slipping clutch mechanism prevents this overdrive tearing or otherwise separating the backing sheet, although a tension will be maintained therein at all times. The second output roller 60 is not directly driven except by frictional engagement with the first output roller 58 through the backing sheet passing therebetween.

It will be understood that whilst the feed mechanism depicted is adapted for supplying of a backing sheet having labels thereon to a printing mechanism it could easily be adapted for the supplying of a printing ribbon or foil through a printer simultaneously with a backing sheet carrying labels. Such an arrangement would ensure that the printing foil or ribbon is only advanced when required and tension is maintained throughout.

In order to ensure that the backing sheet and the labels carried thereon are positioned correctly below the printer head 46 it is preferable to provide one or more photocells 68 positioned to detect the gaps between labels carried on the backing sheet so that the labels can be positioned accurately.

The invention is not confined to the foregoing details and variations may be made thereto within the scope of the invention. For example, the positioning mechanism 40 could be modified by the inclusion of means located between the print roller 56 and the output roller 58 to remove labels from the backing sheet for application to a product or package. The mechanism 40 could also be modified to provide tension and positioning for an inking medium feed to a print head. The printing mechanism could also be omitted for tensioning prior to label application. Other variations may also be possible.

I claim:

1. Label printing apparatus comprising a printer head for printing information on a plurality of labels carried on a backing sheet, a carrier plate having the printer head mounted thereon, hinge means, the carrier plate being hingedly mounted by said hinge means along one edge thereof for displacement between a first printing position and a second non-printing position, the apparatus including compression spring means arranged for urging the carrier plate towards the first printing position with a first biasing force, first magnetic means having a polarity for using the carrier plate towards the second non-printing position with a second biasing force against the first biasing force of the spring means, and a second magnetic means having a selectively reversible polarity causing the carrier plate to be displaced into one of a first printing position against the second biasing force, and the second non-printing position against the first biasing force in accordance with a selected polarity of the second magnetic means.

2. Apparatus as claimed in claim 1 in which the first magnetic means is a permanent magnet.

3. Apparatus as claimed in claim 1 in which the second magnetic means is an electro-magnet such that its polarity is reversible to attract or repel the carrier plate as required.

4. Apparatus as claimed in claim 1 in which the first and second magnetic means are electro-magnets having separate windings arranged around a common core piece.

5. Apparatus as claim 1 in which the first and second magnetic means and the spring are located substantially at a free edge of the carrier plate opposite the said hinge means by which the printer head is mounted on the carrier plate.

6. Label printing apparatus according to claims 1 further comprising a feed mechanism for moving the plurality of labels carried on the backing sheet to the printer head, the feed mechanism including a supply reel carrying the backing sheet in the form of a roll, and a plurality of guides operative to define a feed path for the backing sheet at least between the supply reel and the printer head, wherein at least two of the plurality of guides comprise first and second input rollers around each of which the backing sheet is at least partially looped, at least one of the first and second input rollers being rotatably driven by drives means which also serve to drive at least one output roller located below the printer head and around which the backing sheet is passed.

7. Apparatus as claimed in claim 6 in which the feed mechanism further includes a print roller below the printer head and around which the backing sheet passes before passing to the at least one output roller.

8. Apparatus as claimed in claim 7 in which the first and second input rollers are arranged such that their axes of rotation are arranged substantially parallel to each other and in a plane parallel to that of the backing sheet as it travels to the print roller, the backing sheet being looped around the first input roller located substantially nearer to the print roller than the second input roller, the backing sheet then being guided away from the print roller until it is looped around the second input roller through an angle of at least 180° before being fed onto the print roller.

9. Apparatus as claimed in claim 8 in which the first and second input rollers are connected by a linkage, such that both input rollers are driven by the same drive means.

10. Apparatus as claimed in claim 9 in which the linkage is a gear mechanism.

11. Apparatus as claimed in claim 6 in which the drive means includes a slipping clutch mechanism such that a tension is maintained on the backing sheet as it passes the printer head.

12. Apparatus as claimed in claim 6 in which the drive means comprises motor means and a flexible drive belt connected to said at least one output roller and to said at least one input roller.

13. Apparatus as claimed in claim 6 in which the first and second input rollers are provided so as to form guide paths for a printer inking medium and are operative to move that inking medium past the printer head when it is required to print characters onto a label carried on the backing sheet.

* * * * *